US005848341A

United States Patent [19]

Watanabe

[11] Patent Number: 5,848,341

[45] Date of Patent: Dec. 8, 1998

[54] CLEANING APPARATUS WITH TAKE-UP ROLLER MOVABLE THROUGH A PRESCRIBED ANGLE

[75] Inventor: Kenichi Watanabe, Shinshiro, Japan

[73] Assignee: Minolta Co., Ltd., Osaka, Japan

[21] Appl. No.: 835,713

[22] Filed: Apr. 10, 1997

[30] Foreign Application Priority Data

Apr. 12, 1996 [JP] Japan ..... 8-090850

[51] Int. Cl.[6] ..... G03G 21/00

[52] U.S. Cl. ..... 399/352; 15/256.5; 15/256.51; 399/71; 399/327

[58] Field of Search ..... 399/352, 327, 399/324–326, 71, 343; 15/256.51, 256.53, 250.12, 256.5; 347/32, 33

[56] References Cited

U.S. PATENT DOCUMENTS 4,557,588 12/1985 Tomosada ..... 399/343
5,168,314 12/1992 Gunji et al. ..... 399/327

FOREIGN PATENT DOCUMENTS 58-182671 10/1983 Japan .
58216273 12/1983 Japan .

*Primary Examiner*—Arthur T. Grimley
*Assistant Examiner*—Quana Grainger
*Attorney, Agent, or Firm*—McDermott, Will & Emery

[57] ABSTRACT

A cleaning device is disclosed having a web pressed against a fixing roller for cleaning, a wind-up roller taking up the web by its rotation, a motor rotating the wind-up roller, a counter accumulating the number of treatments by the fixing roller, and a control unit actuating the motor to rotate the wind-up roller by a prescribed angle whenever the number of the treatments reaches a prescribed value, and changing the value in accordance with the number of treatments accumulated by the counter. This device actuates the motor to rotate the wind-up roller taking up the web so that the prescribed value as the web feeding timing corresponding to one actuation of the motor may be increased in accordance with the cumulative number of treatments by the fixing roller. Owing to this control, the web can be fed out in a fixed amount by a simple construction even when the outside diameter of the wind-up roller with the web continues to increase.

20 Claims, 8 Drawing Sheets

Fig.7

| n | 1 | 2 | 3 | 4 | 5 | 6 | 7 |
|---|---|---|---|---|---|---|---|
| Cn ($\times 10^3$) | 0 ~ 34 | 35 ~ 73 | 74 ~117 | 118 ~166 | 167 ~220 | 221 ~279 | 280 ~342 |
| Tn Number of prints /one actuation | 7 | 8 | 9 | 10 | 11 | 12 | 13 |

CLEANING APPARATUS WITH TAKE-UP ROLLER MOVABLE THROUGH A PRESCRIBED ANGLE

BACKGROUND OF THE INVENTION

1. Field of the Invention

This invention relates to a cleaning device for cleaning a component while keeping a web pressed against the component.

2. Description of the Prior Art

Heretofore, a device using a sheetlike web has been known as a cleaning device for a fixing roller, for example, in an image forming apparatus such as a printer. This web, when brought into fast contact with the fixing roller, removes toner and other defiling substances adhering to the surface of the fixing roller. The web has another function of impregnating a release agent such as silicon oil, allowing the impregnated release agent to adhere to the surface of the fixing roller while the web remains in contact with the fixing roller, and consequently enabling the fixing roller to acquire an improved ability to release therefrom a paper as the recording medium.

The cleaning device of this kind is provided with a web roller having a web set in a wound state thereon, a wind-up roller for taking up the web, and a motor for rotating the wind-up roller. The web set on the web roller is wound on the wind-up roller by the fact that the wind-up roller is rotated by the driving force of the motor as interlocked with the image forming operation. Specifically, the motor winds the web by turning at a fixed speed in a fixed length of time per a stated number of prints, namely making a rotation by a fixed angle. As a result, the web is enabled to retain constantly a highly satisfactory cleaning quality.

Incidentally, in the conventional cleaning device, the web, while in service, is wound by rotating the wind-up roller invariably by a fixed angle without reference to the amount of the web already wound on the wind-up roller.

During the initial stage of the web use of this cleaning device, therefore, the amount of the web to be wound by one actuation of the motor is small. Because the amount of the web already wound on the wind-up roller is not very large and thus, the outside diameter of the wind-up roller with the web is small. Subsequently, the outside diameter of the wind-up roller with the web gradually grows in accordance as the rotation of the wind-up roller continues. In brief, the problem inevitably ensues that the amount of the web to be wound by one drive of the motor will increase and the amount of the web to be fed out per print will vary.

SUMMARY OF THE INVENTION

The invention has been produced for solving the problems encountered by the prior art. An object of the invention is to provide a cleaning device which is capable of feeding a web in a fixed amount to clean by a simple construction even when the outside diameter of the wind-up roller with the web continues to increase.

To accomplish the object, the cleaning device according to this invention comprises;

- a web being arranged to press against a subject to be cleaned, thereby cleaning said subject,
- a wind-up roller taking up the web by its rotation,
- a drive unit rotating the wind-up roller,
- a counter accumulating the number of treatments by subject, and
- a control unit actuating the drive unit to rotate the wind-up roller by a prescribed angle whenever the number of the treatments reaches a prescribed value, and changing the value in accordance with the number of treatments accumulated by the counter.

In other words, this cleaning device is, in response to the cumulative number of treatments to subject, controlled to increase the prescribed value as the web feeding timing corresponding to one operation of actuating the drive unit to rotate the wind-up roller for taking up the web. Owing to this control mechanism, the web can be fed out in a fixed amount by a simple construction even when the outside diameter of the wind-up roller with the web continues to increase. The cleaning device, therefore, enables the cleaning web to be fed out in a fixed amount in spite of the simplicity of construction owing to the absence of any need for a special mechanism and, as a result, permits elongation of the service life of the web and stabilization of the cleaning quality.

This invention preferably provides a cleaning device further with a feed roller which is wound with the web and feeds out the web by the rotation of the wind-up roller, the web contacting the subject between the feed roller and the wind-up roller.

The subject may be a fixing roller provided for a fixing device, for example. The number of treatments may constitute the number of sheets used for the fixture by the fixing device or the number of rotations of the fixing roller.

Preferably this invention provides a cleaning device further with a pressure roller which presses the web against the subject. In this case, the cleaning device is further provided with a transmission which transmits the driving force of the drive unit to both the wind-up roller and the pressure roller. Properly, the transmission should transmit the driving force of the drive unit in such a manner that a circumferential speed of the wind-up roller may be greater than that of the pressure roller.

The cleaning device may be utilized for such an image forming apparatus as a printer.

BRIEF DESCRIPTION OF THE DRAWINGS

FIG. 7 is a diagram illustrating print repetition frequency Tn (n=1–7) as the web feeding timing decided stepwise in advance, corresponding to the cumulative number range Cn (n=1–7) of printed sheets indicated stepwise.

DETAILED DESCRIPTION OF THE INVENTION

Now, one example of this invention will be described below with reference to the accompanying drawings.

Figure 1:
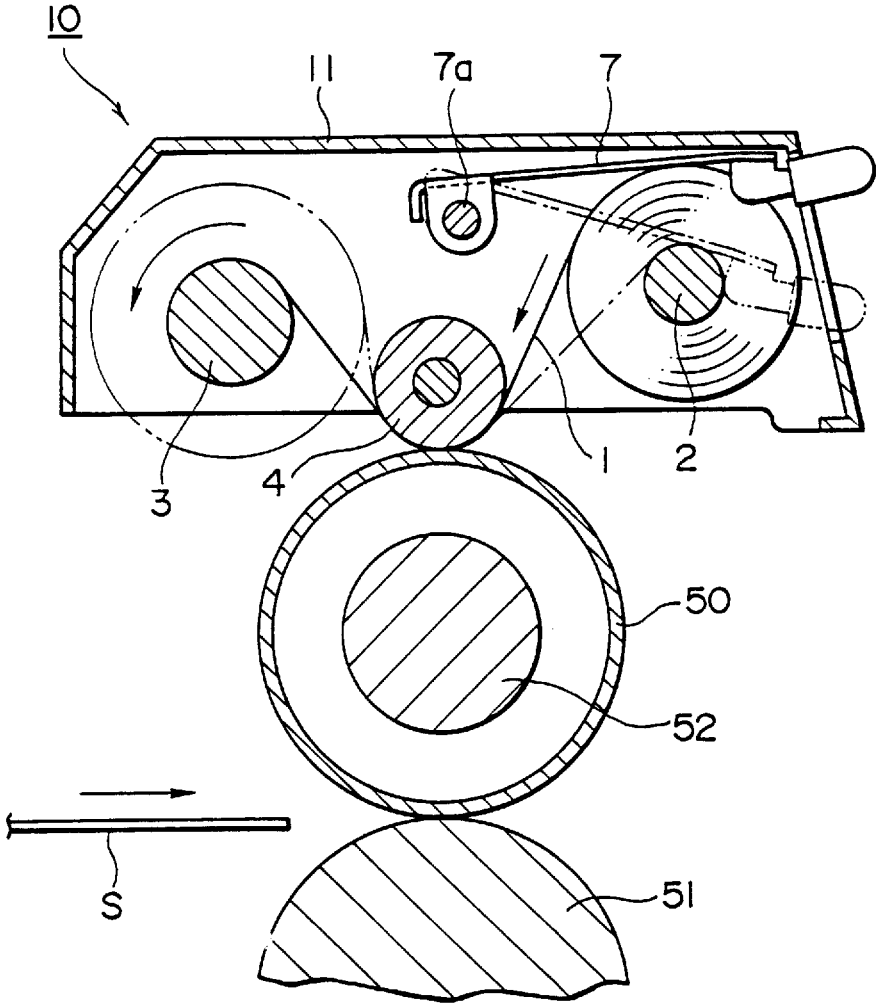
FIG. 1 is a cross section illustrating a cleaning device according to an example of this invention in conjunction with a fixing roller.
Figure 2:
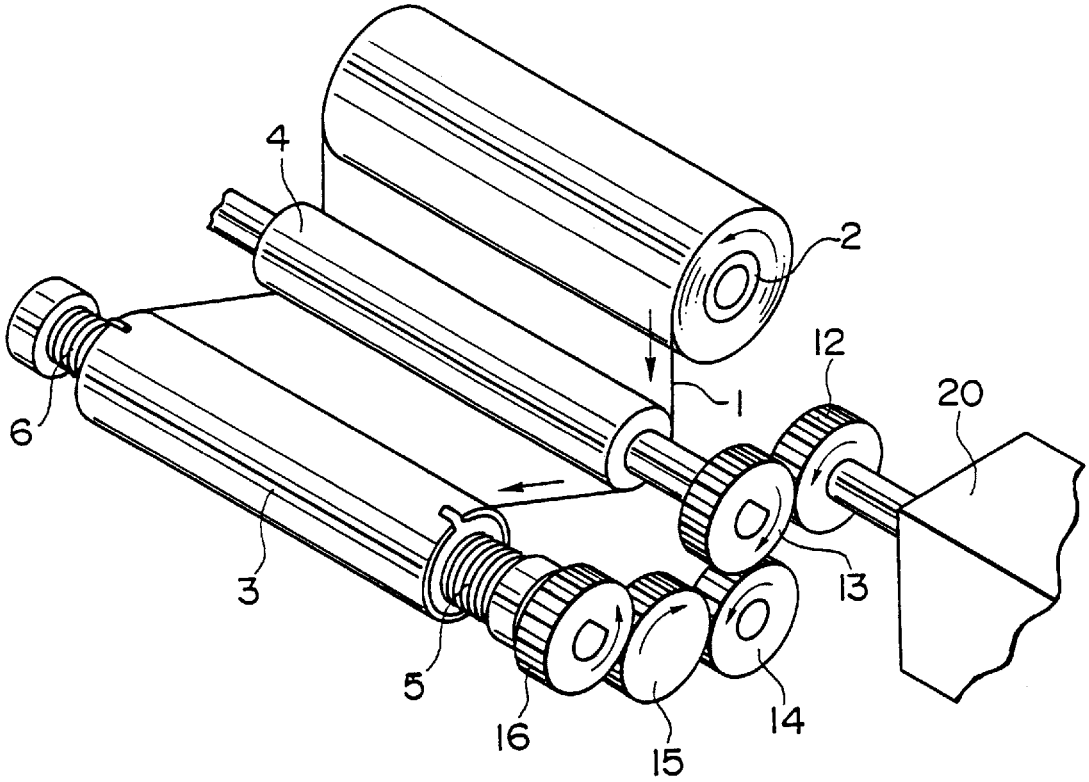
FIG. 2 is a schematic perspective view illustrating a drive system of the cleaning device shown in FIG. 1.

FIG. 1 is a cross section illustrating a cleaning device according to an example of this invention in conjunction with a fixing roller. And FIG. 2 is a schematic perspective view illustrating drive system of the cleaning device shown in FIG. 1.

The image forming apparatus such as a printer is provided with a fixing device which fixes a transferred toner image on a paper as a recording medium, for example, recording paper or transfer paper.

As illustrated in FIG. 1, this fixing device is provided with a fixing roller 50 for thermally fusing a toner on a paper S and a pressure roller 51 for pressing the paper against the fixing roller 50 to nip the paper therebetween. The fixing roller 50 is formed in a hollow shape and is provided therein with an axially retained electrical heating element 52 which heats the outer wall of the fixing roller 50 to a temperature fit for the fixture. The fixing roller 50 and the pressure roller 51 in the state rotate in mutually opposite directions while keeping contact with each other to nip the paper S coated with the toner which is moving in the direction of an arrow shown in the diagram. In an area of contact between the fixing roller 50 and the pressure roller 51, the toner on the paper S is melted by the heat of the fixing roller 50 and fixed on the paper by the pressure from both the two rollers 50 and 51.

The outer surface of the fixing roller 50 is gradually defiled by such a deposit as the toner transferred from the surface of the paper S in response to the number of treatments by the fixing device or the number of fixed papers (number of prints). However, the outer surface of the fixing roller 50 must be deprived of the defiling substance to ensure perfect fixture constantly. Therefore, the fixing roller 50 as the subject to be cleaned is provided in the proximity with a cleaning device 10 as illustrated in FIG. 1.

This cleaning device 10 is provided with a casing 11 as illustrated in FIG. 1. Inside this casing 11 are disposed a web roller 2 wound with a web 1 formed of non-woven fabric impregnated with silicone oil, a wind-up roller 3 sequentially taking up the web 1 set on the web roller 2, and an oil coating roller 4 interposed between the web roller 2 and the wind-up roller 3 for pressing the web 1 against the fixing roller 50. A motor 20 as a drive unit to rotate the oil coating roller 4 and the wind-up roller 3 through gears 12–16 is provided as illustrated in FIG. 2.

The circumferential speed on the outside diameter of the wind-up roller 3 rotated by the motor 20 is set, by the gears 12–16, so as to be slightly greater than on the oil coating roller 4. This slight difference is intended to prevent the web 1 from sagging under the feeding operation.

The wind-up roller 3 comprises the shaft provided on one end with a kick spring 5 for forcibly winding the arriving web 1 on the wind-up roller 3. This kick spring 5 exerts a resilient force on the wind-up roller 3 toward its axis to rotate in the direction of winding the web 1 on the wind-up roller 3. As a result, the resilient force continues to exert uniform tension on the web 1 and prevents the web from sagging or gathering wrinkles. The shaft of the wind-up roller 3 is further provided on the other end with a one-way clutch 6 to prevent the shaft of the wind-up roller 3 from reverse rotation.

The web roller 2, which is a driven roller, rotates by following the advance of the web 1 and, at the same time, receives a frictional force from a keep plate 7 (FIG. 1) to prevent the web 1 from sagging. Specifically, the keep plate 7 is urged by such an elastic member as a torsion coil spring (not shown) in the direction of colliding against the substantially upper part of the web 1 which is set on the web roller 2 with a shaft 7*a* as the center.

Figure 3:
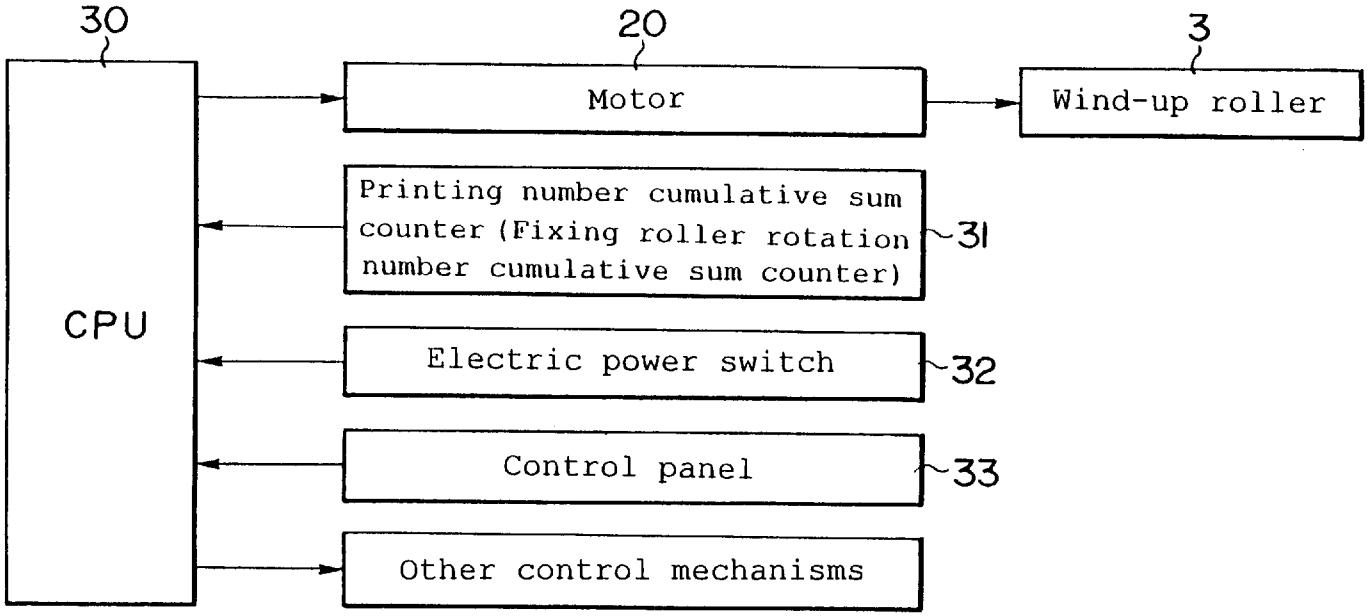
FIG. 3 is a schematic block structural diagram of a printer equipped with the cleaning device.

FIG. 3 is a schematic block structural diagram of a printer equipped with the cleaning device of the present example. This printer is provided with a CPU 30 as a control unit. The CPU 30 is connected to not only the motor 20 for rotating the wind-up roller 3 through the gears 12–16 but also a cumulative sum counter 31 as a counter accumulating the number of printed sheets from the start of web use of the cleaning device 10. The CPU 30 is further connected to an electric power switch 32 for the power supply, a control panel 33 used by various operations of an operator and various indications, and other control mechanisms such as motors for driving various rollers installed within the printer.

The motor 20 is controlled by the instruction from the CPU 30 so as to rotate at a prescribed angle every time the total number of prints (equivalent to the number of treatments) reaches a prescribed print repetition frequency T. In short, the prescribed print repetition frequency T gives a web feeding timing such that the motor 20 winds the web 1 by one actuation every time the number of printed sheets reaches the value T.

The motor 20 rotates at a fixed speed for a fixed duration of time, namely rotates at a fixed angle, each time the number of printed sheets reaches the value T. And the web 1 set on the web roller 2 is sequentially wound by the rotation of the wind-up roller 3 in response to actuation of the motor 20 through the gears 12–16.

The CPU 30 is particularly constructed to control the change of the print repetition frequency T as the web feeding timing equivalent to one actuation of the motor 20 which rotates the wind-up roller 3 to take up the web, based on the cumulative total C of printed sheets (equivalent to the accumulative number of treatments) as a signal outputted by the cumulative sum counter 31.

Figure 4A:
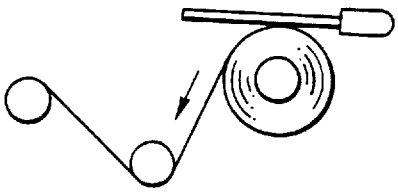
FIG. 4A is a diagram illustrating the state of a web in the initial stage of use.
Figure 4B:
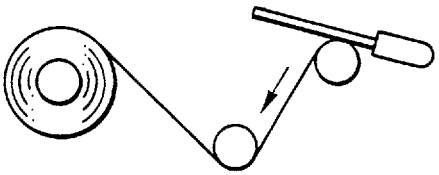
FIG. 4B is a diagram illustrating the state of the web in the final stage of use.

During the initial stage of the use of the web (FIG. 4A), the amount of the web 1 already wound on the wind-up roller 3 is not very large and the outside diameter of the wind-up roller 3 including the web is still small. Thus, the amount of the web to be wound by one actuation of the motor is small. Subsequently, the amount of the web to be wound per one operation of the motor 20 gradually increases as the winding of the web advances (FIG. 4B). The present example contemplates averaging the web feeding amount per printed sheet by gradually increasing the prescribed print repetition frequency T which is regarded as the operating timing for the motor 20.

The present example uses the number of printed sheets as the basis for controlling the web feeding timing. It may be the alternative to use the number of rotations of the subject (for example, the fixing roller).

Now, the operation of the cleaning device during the image forming operation of the printer will be described below with reference to the flow charts of FIGS. 5 and 6.

Figure 5:
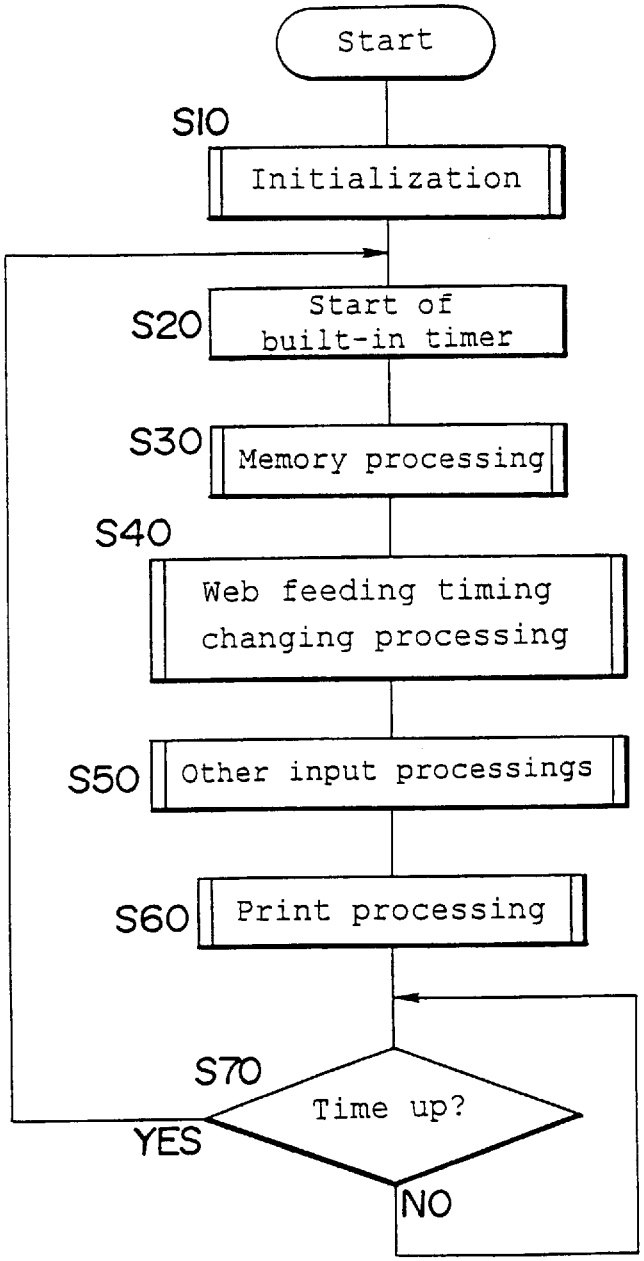
FIG. 5 is a main flow chart of the image forming operation of the printer with the cleaning device.

FIG. 5 is a main flow chart of the image forming operation of the printer with the cleaning device. And FIG. 6 is a subroutine for changing the web feeding timing shown in FIG. 5.

As illustrated in FIG. 5, the CPU 30 is initialized (Step S10) and a built-in timer of the CPU 30 is started (Step S20) when the electric power switch 32 is turned on to supply the electric power to the printer. Subsequently, various processing of the memory concerning the status of paper feeding, etc. is executed (Step S30). And the processing for changing the web feeding timing is done (Step S40).

Then, data such as the number of printed sheets is inputted through the control panel 33 (Step S50). When the CPU 30 detects a print signal, the print process is executed (Step S60).

The motor 20 is so constructed that the motion of taking up the web 1 by the drive of the motor 20 may be done once per the prescribed print repetition frequency T in response to, for example, the image forming process in the relevant print process. The pressure of the web 1 against the fixing roller 50 leads to clean and coat the surface of the fixing roller 50 with silicone oil. At Step S70, the time adjusting processing is done by detecting the working time of the built-in timer for the start of the next operation.

FIG. 7 is a table illustrating the functional relation between the prescribed print repetition frequency Tn (n=1–7) decided stepwise in advances as the web feeding timing and the cumulative number range Cn (n=1–7) of printed sheets.

Figure 6:
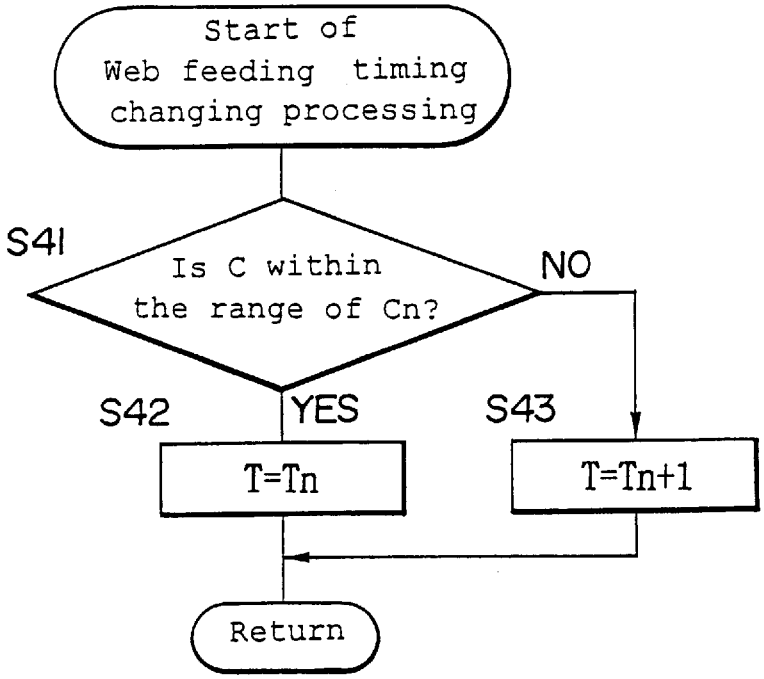
FIG. 6 is a subroutine for changing the web feeding timing shown in FIG. 5.

In the processing for changing the web feeding timing (Step S40 in FIG. 5), the CPU 30 first judges, as shown in FIG. 6, whether or not the cumulative number C of printed sheets as a signal outputted from the cumulative sum counter 31 falls within the current cumulative number range Cn of printed sheets (Step S41), wherein the current cumulative number range Cn (n=1–7) is decided in advance as divided into n stages, i.e. the first through the n'th stage, of the period from the initial through the final stages of the use of the web.

When the cumulative number C of printed sheets is, in Step S41, judged to be still within the first-stage (n=1), namely when the cumulative number C falls within 0–34×$10^3$ [the number of sheets] as the first-stage value C1 shown in FIG. 7, the CPU 30 sets the web feeding timing or the prescribed print repetition frequency T at T1 (7 sheets per actuation) as the prescribed first-stage value shown in FIG. 7. The web feed amount W per printing in this case, therefore, is defined as W=[web winding amount per actuation of motor]/7.

Figure 8:
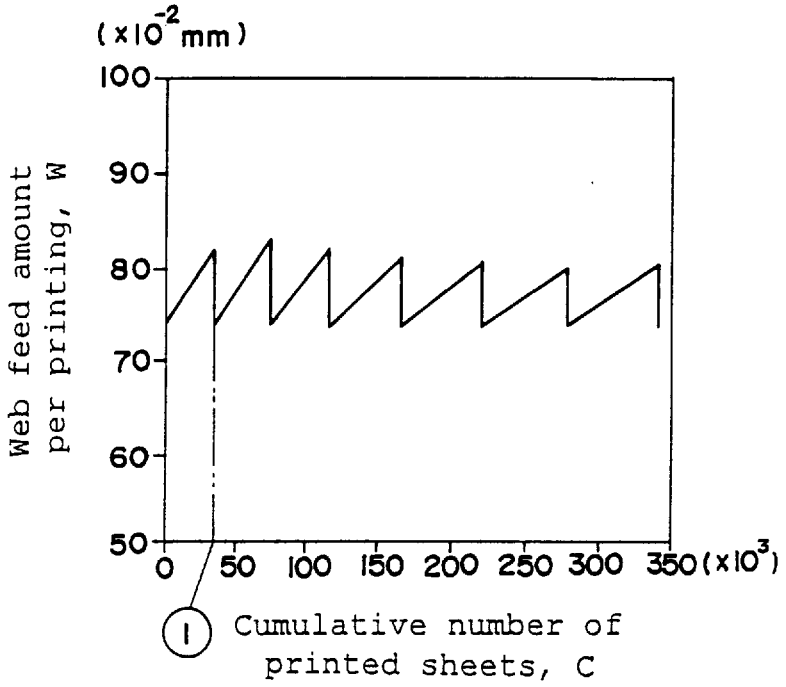
FIG. 8 is a graph showing the relation between the web feed amount W per printing and the cumulative number C of printed sheets.

FIG. 8 is a graph showing the relation between the web feed amount W per printing and the cumulative number C of printed sheets.

So long as the cumulative number C remains within the range of the value C1, 0–34×$10^3$ [the number of sheets], the motor 20 is repeatedly actuated to wind the web 1 every time the total of printed sheets reaches 7. Thus, the outside diameter of the wind-up roller 3 including the web 1 grows and the web winding amount per actuation of motor 20 gradually increases. As a result, the web feed amount W per printing increases proportionately to the cumulative number C of printed sheets between 0 and 34×$10^3$ [the number of sheets] as shown in FIG. 8.

When the cumulative number C of printed sheets is, in Step S41, judged not to fall within the first-stage value C1 of cumulative number range of printed sheets shown in FIG. 7, the CPU 30 changes the prescribed print repetition frequency T as the web feeding timing to the second-stage value T2 (8 sheets per actuation) shown in FIG. 7. As a result, the web feed amount W per printing changes to W=[web winding amount per actuation of motor]/8.

The web feed amount W per printing decreases stepwise to the initial value of the initial stage at the point ① where the cumulative number C of printed sheets is 34×$10^3$ [the number of sheets] as shown in FIG. 8.

In the present example, the boundary values of the cumulative number range Cn (n=1–7) of printed sheets are defined so that the web feed amount W per printing may be decreased stepwise to the initial value existent during the first stage of use when the prescribed print repetition frequency Tn as the web feeding timing changes. The boundary values do not always need to be set as described above but may be slightly varied. The prescribed print repetition frequency Tn as the web feeding timing changes for one sheet after another in the example. Where the width of variation allows, the change may be made for every two sheets, for example.

The same procedure for changing the web feeding timing is executed after the cumulative number range C1 of printed sheets has shifted to the second-stage value C2 shown in FIG. 7. In brief, the motor 20 is repeatedly actuated to wind the web 1 every time the total of printed sheets reaches the value which is sequentially changed from 7 to 13.

Figure 9:
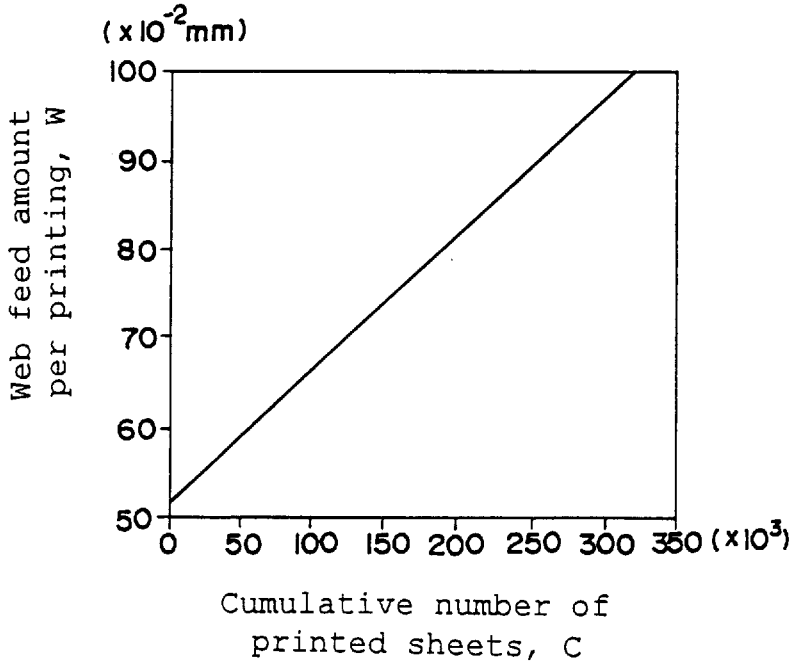
FIG. 9 is a graph showing the relation between the web feed amount W per printing and the cumulative number C of printed sheets obtained when the print number is fixed as the web feeding timing.

As a result, the web feed amount W per printing is averaged to fall within a certain range without reference to the increase in the cumulative number C of printed sheets as shown in FIG. 8. In the conventional cleaning device using a fixed number of printed sheets as the web feeding timing the web feed amount W per printing continues to increase proportionately to the increase in the cumulative number C of printed sheets (FIG. 9). However, in this invention can, with the addition of a simple construction, preclude the situation. As a result, the web will be fed out in a fixed amount and efficient and infallible cleaning will be done. Consequently, the service life of the web can be elongated and the cleaning ability can be stabilized.

It is evident that the invention is not limited to the particular examples shown and described herein, but that various changes and modifications may be made therein by persons of ordinary skill in the art within the scope of the technical idea of this invention.

While the preceding examples have been described with respect to the cleaning device for the fixing roller in the printer, this invention can be applied to various types of cleaning devices which pressing a web against a subject to be cleaned, such as, a cleaning device for a photosensitive member in an image forming apparatus. The web does not always require to be impregnated with oil but may be only required to fulfill a cleaning function. The material for the web does not need to be limited to that which is described in the example.

The entire disclosure of Japanese Patent Application No. 8-090850 filed on Apr. 12, 1996 including specification, claims, drawings and summary are incorporated herein by reference in its entirety.

I claim:

1. A cleaning device comprising:

a web being arranged to press against a subject to be cleaned, thereby cleaning said subject, a wind-up roller taking up said web by its rotation, a drive unit rotating said wind-up roller, a counter accumulating the number of treatments by said subject, and a control unit actuating said drive unit to rotate said wind-up roller by a prescribed angle whenever the number of said treatments reaches a prescribed value, and changing said prescribed value in accordance with a cumulative number of treatments accumulated by said counter, said prescribed angle of rotating said wind-up roller being constant regardless of the cumulative number of treatments.

2. A cleaning device according to claim 1, further comprising:

a feed roller which is wound with said web and feeds out said web by the rotation of said wind-up roller, said web contacting said subject between said feed roller and said wind-up roller.

3. A cleaning device according to claim 1, wherein said subject is a fixing roller provided for a fixing device.

4. A cleaning device according to claim 3, wherein said number of treatments is the number of sheets used for fixture by said fixing device.

5. A cleaning device according to claim 3, wherein said number of treatments is the number of rotations of said fixing roller.

6. A cleaning device according to claim 1, further comprising:

a pressure roller which presses said web against said subject.

7. A cleaning device according to claim 6, further comprising:

a transmission which transmits the driving force of said drive unit to both said wind-up roller and said pressure roller, said transmission transmitting said driving force of said drive unit so that a circumferential speed of said wind-up roller may be greater than that of said pressure roller.

8. An image forming apparatus comprising:

a subject to be cleaned, a web being arranged to press against said subject, thereby cleaning said subject, a wind-up roller taking up said web by its rotation, a drive unit rotating said wind-up roller, a counter accumulating the number of treatments by said subject, and a control unit actuating said drive unit to rotate said wind-up roller by a prescribed angle whenever the number of said treatments reaches a prescribed value, and changing said prescribed value in accordance with a cumulative number of treatments accumulated by said counter, said prescribed angle of rotating said wind-up roller being constant regardless of the cumulative number of treatments.

9. An image forming apparatus according to claim 8, further comprising:

a feed roller which is wound with said web and feeds out said web by the rotation of said wind-up roller, said web contacting said subject between said feed roller and said wind-up roller.

10. An image forming apparatus according to claim 8, wherein said number of treatments is the number of sheets on which said image forming apparatus has formed an image.

11. An image forming apparatus according to claim 8, wherein said subject is a fixing roller provided for a fixing device.

12. An image forming apparatus according to claim 11, wherein said number of treatments is the number of rotations of said fixing roller.

13. An image forming apparatus according to claim 8, further comprising:

pressure roller which presses said web against said subject.

14. An image forming apparatus according to claim 13, further comprising:

a transmission which transmits the driving force of said drive unit to both said wind-up roller and said pressure roller, said transmission transmitting said driving force of said drive unit so that a circumferential speed of said wind-up roller may be greater than that of said pressure roller.

15. A method for cleaning a subject by pressing a web against said subject, comprising:

a step of actuating a wind-up roller for rotating said roller by a prescribed angle to take up said web whenever the number of treatments by said subject reaches a prescribed value, a step of accumulating the number of treatments by said subject, and a step of changing said prescribed value in accordance with the accumulated number of treatments, said prescribed angle of rotating said wind-up roller being constant regardless of the accumulative number of treatments.

16. A method according to claim 15, wherein said web is wound on a feed roller, wherein said web is fed out by the rotation of said wind-up roller, and wherein said web contacts said subject between said feed roller and said wind-up roller.

17. A method according to claim 15, wherein said subject is a fixing roller provided for a fixing device, and wherein said number of treatments is the number of sheets used for fixture by said fixing device.

18. A method according to claim 15, wherein said subject is a fixing roller provided for a fixing device, and wherein said number of treatments is the number of rotations of said fixing roller.

19. A method according to claim 15, wherein said web is pressed against said subject by a pressure roller.

20. A method according to claim 19, wherein a circumferential speed of said wind-up roller is greater than that of said pressure roller.

* * * * *

UNITED STATES PATENT AND TRADEMARK OFFICE

CERTIFICATE OF CORRECTION

PATENT NO. : 5,848,341

DATED : December 8, 1998

INVENTOR(S) : Kenichi Watanabe

It is certified that error appears in the above-identified patent and that said Letters Patent is hereby corrected as shown below:

Col. 8, l. 6,: At the beginning of the line, insert --a--

Col. 8, l. 22: Change "the" to --a--

Col. 8, l. 29: Change "the accumulated" to --a cumulative--

Signed and Sealed this

Twenty-first Day of December, 1999

*Attest:*

Q. TODD DICKINSON

*Attesting Officer*

*Acting Commissioner of Patents and Trademarks*